US007214407B2

(12) United States Patent
Oddersborg

(10) Patent No.: US 7,214,407 B2
(45) Date of Patent: May 8, 2007

(54) METHOD FOR THE PREVENTION OF BARNACLE ATTACKS

(75) Inventor: Jimmy Skov Oddersborg, Svendborg (DK)

(73) Assignee: Teredo Marine Protection ApS, Svendborg (DK)

( * ) Notice: Subject to any disclaimer, the term of this patent is extended or adjusted under 35 U.S.C. 154(b) by 0 days.

(21) Appl. No.: 10/493,430

(22) PCT Filed: Sep. 20, 2002

(86) PCT No.: PCT/DK02/00613

§ 371 (c)(1),
(2), (4) Date: May 20, 2004

(87) PCT Pub. No.: WO03/035342

PCT Pub. Date: May 1, 2003

(65) Prior Publication Data

US 2005/0019497 A1 Jan. 27, 2005

(30) Foreign Application Priority Data

Oct. 25, 2001 (DK) ..... 2001 00290 U
May 23, 2002 (DK) ..... 2002 00796

(51) Int. Cl.
*B05D 7/06* (2006.01)
*B05D 7/22* (2006.01)

(52) U.S. Cl. ..... 427/230; 427/238

(58) Field of Classification Search ..... 427/230, 427/238; 106/15.05
See application file for complete search history.

(56) References Cited

U.S. PATENT DOCUMENTS

| | | | | |
|---|---|---|---|---|
| 1,936,439 | A | 11/1933 | Siever | 427/291 |
| 4,220,688 | A * | 9/1980 | Mitchell et al. | 428/541 |
| 4,223,919 | A * | 9/1980 | Kurachi | 285/8 |
| 4,766,113 | A * | 8/1988 | West et al. | 514/187 |
| 5,525,721 | A | 6/1996 | Oshima et al. | 536/69 |
| 5,582,871 | A | 12/1996 | Silenius et al. | 427/393 |
| 6,033,150 | A * | 3/2000 | Culen | 405/216 |

FOREIGN PATENT DOCUMENTS

| | | | |
|---|---|---|---|
| CH | 415 016 | | 12/1966 |
| DE | 50295 | | 5/1889 |
| DE | 380986 | | 7/1920 |
| DE | 1259087 | | 1/1968 |
| FR | 2663586 | | 12/1991 |
| GB | 677364 | * | 8/1952 |
| GB | 770918 | * | 3/1957 |
| GB | 2 259 099 | | 3/1993 |
| WO | WO 96/23635 | | 8/1996 |
| WO | WO 97/34747 | | 9/1997 |

* cited by examiner

*Primary Examiner*—William Phillip Fletcher, III
(74) *Attorney, Agent, or Firm*—James Creighton Wray

(57) ABSTRACT

A method for impregnating wooden items, in particular poles situated in marine environment against attack from Teredo, where the method includes the following steps of a) forming a hole in parallel with the fibre orientation of the wood; b) then filling the hole with an impregnating agent containing a biodegradable chelating agent; and c) closing the hole thereafter.

20 Claims, 2 Drawing Sheets

METHOD FOR THE PREVENTION OF BARNACLE ATTACKS

This application claims the benefit of Danish Application No. BA 2001 00290 filed Oct. 25, 2001, PA 2002 00796 filed May 23, 2002 and PCT/DK02/009613 filed Sep. 20, 2002.

BACKGROUND OF THE INVENTION

The present invention concerns a method for impregnating wooden items against attacks from Teredo, particularly poles situated in marine environment.

Teredo is the Latin term for the family of shipworms that mainly live in salty water and mainly live off cellulose, which e.g. is found in wood. Shipworm is a long, worm-shaped bivalve, the shell of which only covering some of the front end of the animal.

Shipworms are active in the entire submerged length of the pole, i.e. from over the bottom to the surface zone. Attack by shipworms often only appears as small holes into which the larvae have disappeared. In the first year, shipworms are male, then changing to female. Reproduction occurs by male and female worms releasing semen and eggs to the water, after which fertilisation and hatching occurs freely in the water. When the larva is hatched, it seeks out a wooden item in the water, including poles and the like. The larva bores into the e.g. pole and lines the passage with a thin layer of lime. In the larva stadium, the shipworm larva is feeding mainly on cellulose fibres from the pole in which it has been born while at the same time eating and growing so that the destructive effect on the pole becomes more and more comprehensive. Thus it is difficult to judge to which extent a given pole is attacked by Teredo.

In order for the Teredo family of shipworms to live, a certain water temperature, a certain saltiness, and wood must be present. In the warmer areas of the Mediterranean Ocean, shipworm attacks have been widespread for a long time, and in recent years the attacks have also spread to Danish waters.

In order to counteract and curb attacks from Teredo, one may use exotic wood species for one's poles, including e.g. cypress wood, jarrah wood, turpentine wood. These and a few other types of wood are naturally resistant against Teredo attacks, but are very rare species of wood as well as they are very expensive. Degrading of the wood cannot be avoided, but the service life of the pole can be prolonged.

Another way of preventing Teredo attacks is to impregnate with chemical means. Since most chemical agents are environmentally hazardous, there is a desire to reduce the use of environmentally harmful agents as these are leached out into the sea water and thereby have negative effect on the marine environment around the pole.

A third method is to use mechanical or chemical barriers. A kind of mechanical barrier is to coat the pole with a copper layer or a concrete layer. This is a costly and cumbersome method, which in many cases makes it advantageous from an economic point of view to let the pole stand untreated, and, when the pole is degraded by Teredo attacks, to substitute it with a fresh pole.

A fourth method for preventing Teredo attacks is to coat the pole externally with a chemical barrier, e.g. in the form of a plastic film impregnated with a chemical material. This method has the same disadvantages as the chemical impregnation of the pole as often there are released very poisonous substances to the surrounding marine environment with associated harmful effects.

Thus there exists a need for producing a cheap and secure impregnation of wooden poles, whereby it is ensured in an environmentally safe way that the poles are safe-guarded against attacks from Teredo.

SUMMARY OF THE INVENTION

This is provided according to the invention by a method which is peculiar in comprising the following steps:

a) a hole is formed in parallel with the fibre orientation of the wood;

b) the hole is then filled with an impregnating agent containing a biodegradable chelating agent;

c) after which the hole is closed.

With the method according to the invention it has surprisingly appeared that the impregnation agent has a good ability to penetrate and disperse out in the wood, and further that the Teredo larvae and worms cannot live when impregnating agent is present in the pores of the wood. Thus there is produced a very efficient protection against shipworm attacks, as well as the method is relatively simple to implement, and furthermore continuous maintenance is easily performed by replenishing impregnation liquid in the holes. As furthermore the impregnating liquid is not environmentally hazardous, the new impregnating method therefore has no influence on the marine environment around the pole.

In a preferred embodiment, the impregnation agent contains chelating agent ranging from 1% to 25%, more preferably 5% to 15%.

Thus there is provided a method which is both cheaper and more rapid than the previously known, as well as it is environmentally neutral compared with the marine environment around the pole.

In order to amplify the ingress of the impregnating agent into the wood, the impregnating agent may be filled into the hole under pressure, preferably with a pressure between 10 and 200 bar. The applied pressure enhances distribution of the impregnation agent in the wood tissue and thereby the impregnation process. However, in this connection, it is to be underlined that the impregnation liquid will disperse in the wood tissue also in the embodiments of the method where pressure is not applied. This is due to the composition of the impregnation agent which has a relatively low surface tension due to the chemical composition.

In the embodiments where pressure on the liquid in the pole is wanted to be applied simultaneously with supplying impregnating agent, this is done by a pipe being placed inside the hole, the pipe being provided with a screw thread for connecting an impregnation agent supply hose. Furthermore, the pipe has the property that it has an outer diameter which is slightly greater than the inner diameter in the hole, whereby the pipe is fixed in the wooden item. Then the supply hose may be connected to a pressurised vessel in which the impregnating agent is provided and then supplied to the wooden item via the supply hose and the pipe.

In a preferred embodiment of the invention, the entire hole in the wooden item in parallel with the fibre orientation is from 1200 mm to 2000 mm deep, and that the hole diameter is from 25 mm to 50 mm, preferably from 30 to 45 mm, and more preferably 38 mm, in a first section closest to an end face at a depth from 0 to 750 mm, and that the hole diameter is from 10 mm to 25 mm, preferably 15 mm to 20 mm, and more preferably 19 mm, in the remaining section of the depth of the hole.

These dimensions have appeared to be optimal on far the most of the kinds of wooden items used for mooring posts and bridge posts, as it is ensured in this way that enough impregnating agent is placed in the hole in the wooden item at the same time as the liquid in disposed deeply enough in the wooden item so that it may penetrate out into the entire pole and hereby protect it efficiently against attack from Teredo.

Besides the mix of water and chelating agents, impregnating agents consisting of water, alcohol and soda, citric acid and similar products have appeared effective against shipworms and usable by the method according to the invention.

In a preferred embodiment of the invention is used an impregnation agent containing from 1% to 25% biodegradable chelating agent. The chelating agent ensures that the impregnating agent is not so easily washed out of the wood but also that an anti-Teredo environment is created.

Where treating very large wooden items, e.g. mooring posts with a large diameter, in a preferred embodiment of the invention there may be provided a plurality of holes parallel with the fibre direction in the end face of each wooden item. Hereby the distance which the impregnating liquid is to penetrate the wood becomes less, whereby a more optimal treatment of the wooden item is ensured so that the impregnation liquid becomes evenly distributed in the entire wooden item.

In a preferred embodiment, the method is particularly applicable on wooden poles, including bridge or mooring posts placed in salty water. There are many of these posts in normal harbours, and particularly in marinas wooden poles are used in great numbers for the construction of landing-stages and mooring posts.

In a further, preferred embodiment of the method according to the invention, on each pole is to be filled with 10 to 50 litres impregnating liquid, preferably 20 to 40 litres, and more preferably 30 litres impregnating agent in each hole. Even though the immediate size of the hole does not allow filling of the total amount of impregnating liquid at once, the filling should be continued until the above indicated amount has been absorbed in the pole.

The filling may possibly occur by the top of the hole being fitted with a reservoir, which contains an amount of impregnating agent, so that, as the impregnating agent is dispersed in the wood pole, the level in the reservoir drops. Thereby it is easy to check when the impregnating agent is to be replenished as well as checking on the filled amount may easily be updated.

In some cases the poles to be treated are erected so that they form a sheet piling, and in some case there is no access to the wood posts above the water level. Under these conditions, by using the invention it is possible to bore a filling hole in the wood pole under water level and then to connect a filling stub. The filling stub is connected with a hose or similar to a tank in which impregnating agent is kept under pressure, e.g. 12–20 bar. In the same way as described above, it is hereby possible to impregnated poles which are not accessible over the water level and/or forming a sheet piling.

Above, the invention has been describe with regard particularly to application on poles which are already placed in a marine environment. The impregnating agent and the effect attained thereby is, however, just as applicable in a compregnation process on new poles. This implies substantial economic savings, as it is more rational to treat several poles at a time than to treat each pole individually on site.

The method will now be explained with reference to the accompanying drawing.

DETAILED DESCRIPTION OF THE PREFERRED EMBODIMENTS

Figure 1:
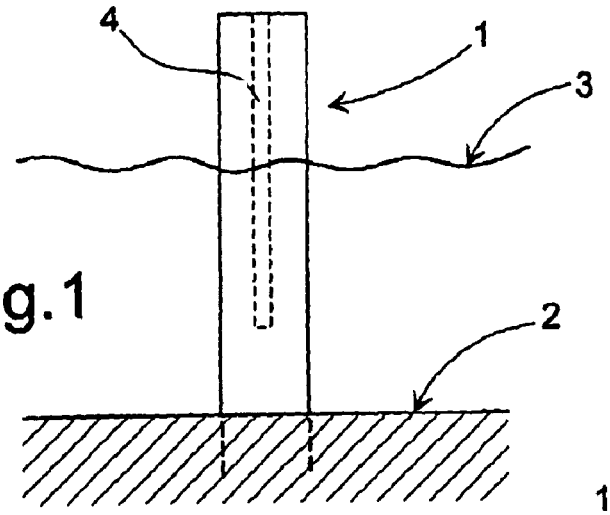
FIG. 1 shows a pole with a bored hole.

In FIG. 1 is illustrated a mooring post 1 placed in a marine environment so that the pole is thrust into the bed 2. The pole will typically protrude up over the water level 3, either to form part of a bridge structure or to be used as mooring post However, in this connection it is to be mentioned that the method according to the invention is not limited to the mooring posts or posts forming part of bridge structures, but may be used for all kinds of wooden items that are exposed to Teredo attack, i.e. wooden items placed in salty, marine environment.

Between the bed 2 and the water level 3, under given conditions, i.e. a given water temperature and salinity, there will be risk of attack from Teredo (pole worm or shipworm).

The invention thus indicates a method for protecting wooden items against attacks from Teredo. In the pole 1 is formed a hole 4 in parallel with the longitudinal orientation of the fibres. The hole is to be deep enough to reach down under the water level, i.e. typically 1½ to 2 m deep.

Figure 2:
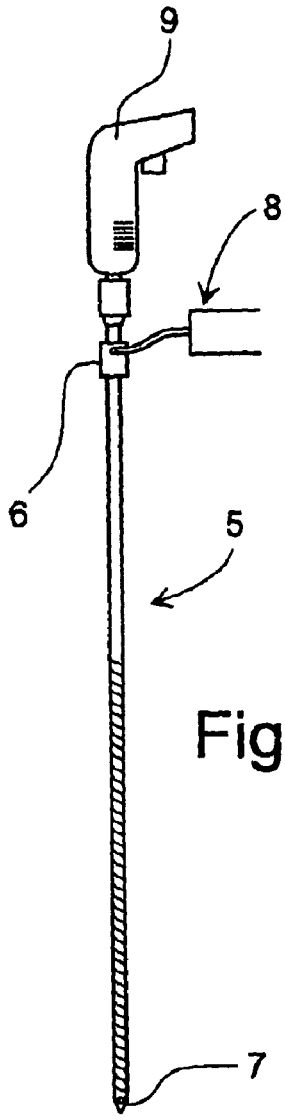
FIG. 2 shows a drilling device for use in the method.

In FIG. 2 is shown a tool used for making the hole 4 in the pole 1. The tool comprises a very long drill 5 corresponding to the depth of the hole, i.e. up to 2 m long. The drill 5 itself is hollow, and an aperture 6,7 is provided at both ends of the drill. In the aperture 6 there may be connected a compressor pumping compressed air down through the drill to the outlet 7. The drill is brought to rotate by means of a drilling machine 9 connected at the upper end of the drill. During the drilling of the hole 4, compressed air is conducted in through the aperture 6, down through the drill 5 and out through aperture 7, in order thereby to remove and enhance transport of wood chips produced by the drilling process up through the hole and out of the pole.

Figure 3:
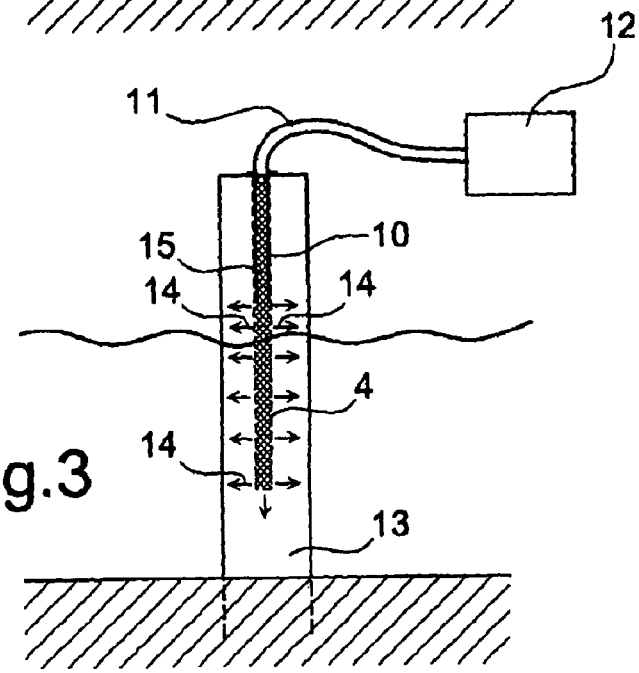
FIG. 3 shows a pole with pressure equipment.

In FIG. 3 is illustrated the succeeding stage of the method according to the invention, as there is inserted a pipe 10 in the upper part of the hole 4. In the pipe 10, there is a connecting facility for a supply hose 11, which is led to a reservoir 12 that possibly may be pressurised. In the reservoir 12, the impregnation agent is placed so that the impregnation agent is conducted through the supply hose into the pipe and thereby into the inner part of the pole. The impregnation agent will disperse into the wood 13 as illustrated with arrows 14. The hole 4 is outlined as filled with impregnating agent 15. When the desired amount of impregnating agent has been supplied to the pole, the connection to the reservoir 12 is disrupted, and supply hose and pipe are then removed from the pole.

Figure 4:
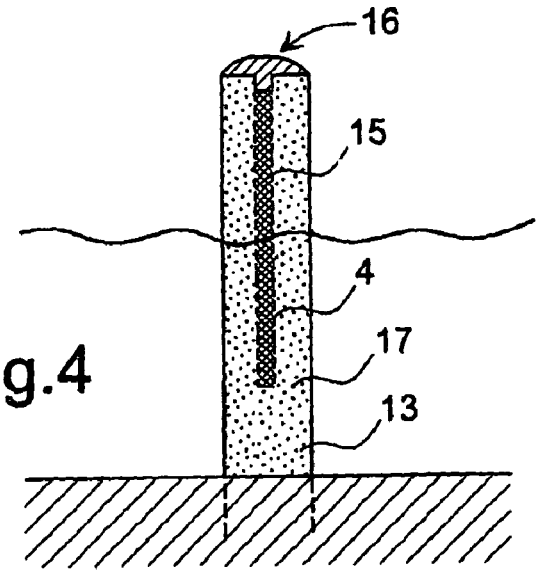
FIG. 4 shows a finished pole.

After finished impregnation, a plug 16 is attached as illustrated in FIG. 4. In the hole 4 there may still stand an amount of impregnating agent 15 which will disperse into the wood 13 over time. The wood is illustrated in FIG. 4 as being impregnated with impregnating agent 15 by 17.

After impregnation, it will be relatively simple to check when the impregnating liquid is to be replenished, as one just removes the plug 16 from the hole 4, whereby access is provided to the hole 4 in the interior of the pole 1. When the impregnating agent level in the hole 4 becomes sufficiently low, more impregnating agent may easily be filled into the hole.

Figure 5:
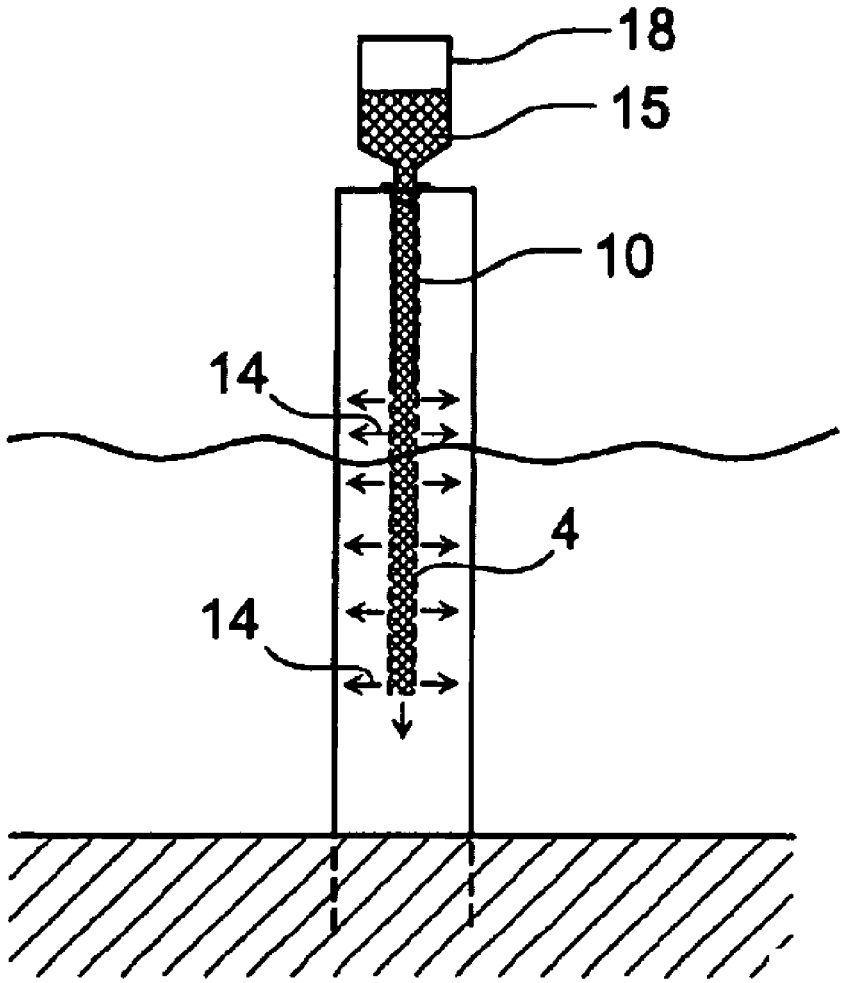
FIG. 5 shows a pole with fitted reservoir.

In an alternative embodiment of the method as illustrated in FIG. 5, supply hose and pressurised reservoir 11,12 have been substituted with a tank 18, which is connected with the hole 4, possibly via a pre-fitted pipe 10. In the tank 18, there is provided an amount of impregnating agent 15 which will be actuated by gravitational force and then disperse in the pole, i.e. the wood as outlined with the arrows 14. When it is detected that the pole has been supplied a predetermined amount of impregnating agent, the tank 18 is removed from the pipe 10, after which the pole is finished as illustrated in FIG. 4.

The invention claimed is:

1. A method for impregnating wood in wooden items in situ in a marine environment, wherein each of the wooden items is disposed in a substantially vertical orientation with at least a portion of the wooden item submerged in water, and wherein each of the wooden items includes a top end face and a bottom end, the method comprising the steps of:

a) forming a hole in parallel with the fibre orientation of the wood, the hole formed with an one end in the top end face and terminating at a closed end within the wooden item above the bottom end thereof, at least a portion of the hole extending within the portion of the wooden item submerged in water, b) filling the hole with an impregnating agent comprising a biodegradable chelating agent, and c) closing the open end of the hole thereafter.

2. The method of claim 1, wherein the wooden items comprise poles situated in a marine environment and impregnating the poles protects the poles against attacks from Teredo.

3. The method of claim 1, wherein the impregnating agent contains chelating agent ranging from 1% to 25%.

4. The method of claim 1, wherein the impregnating agent contains chelating agent ranging from 5% to 15%.

5. The method of claim 1, further comprising before step b) inserting a pipe comprising screw threads at one end for connecting an impregnating agent supply hose.

6. The method of claim 1, further comprising filling the impregnating agent under a pressure between 10 bar and 200 bar.

7. The method of claim 1, wherein the entire hole in the wooden item parallel with the fibre orientation is from 1200 mm to 2000 mm deep, the hole diameter is from 25 mm to 50 mm in a first section closest to the top end face at a depth from 0 mm to 750 mm, and the hole diameter is from 10 mm to 25 mm in the remaining section of the depth of the hole.

8. The method of claim 1, wherein the entire hole in the wooden item parallel with the fibre orientation is from 1200 mm to 2000 mm deep, the hole diameter is from 25 mm to 50 mm in a first section closest to the top end face at a depth from 0 mm to 750 mm, and the hole diameter is from 15 mm to 20 mm in the remaining section of the depth of the hole.

9. The method of claim 1, wherein the entire hole in the wooden item parallel with the fibre orientation is from 1200 mm to 2000 mm deep, the hole diameter is from 25 mm to 50 mm in a first section closest to the top end face at a depth from 0 mm to 750 mm, and the hole diameter is 19 mm in the remaining Section of the depth of the hole.

10. The method of claim 1, wherein the entire hole in the wooden item parallel with the fibre orientation is from 1200 mm to 2000 mm deep, the hole diameter is from 30 mm to 45 mm in a first section closest to the top end face at a depth from 0 mm to 750 mm, and the hole diameter is from 10 mm to 25 mm in the remaining section of the depth of the hole.

11. The method of claim 1, wherein the entire hole in the wooden item parallel with the fibre orientation is from 1200 mm to 2000 mm deep, the hole diameter is from 30 mm to 45 mm in a first section closest to the top end face at a depth from 0 mm to 750 mm, and the hole diameter is from 15 mm to 20 mm in the remaining section of the depth of the hole.

12. The method of claim 1, wherein the entire hole in the wooden item parallel with the fibre orientation is from 1200 mm to 2000 mm deep, the hole diameter is from 30 mm to 45 mm in a first section closest to the to end face at a depth from 0 mm to 750 mm, and the hole diameter is 19 mm in the remaining section of the depth of the bole.

13. The method of claim 1, wherein the entire hole in the wooden item parallel with the fibre orientation is from 1200 mm to 2000 mm deep, the hole diameter is 38 mm in a first section closest to the top end face at a depth from 0 mm to 750 mm, and the hole diameter is from 10 mm to 25 mm in the remaining section of the depth of the hole.

14. The method of claim 1, wherein the entire hole in the wooden item parallel with the fibre orientation is from 1200 mm to 2000 mm deep, the hole diameter is 38 mm in a first section closest to the top end face at a depth from 0 mm to 750 mm, and the hole diameter is from 15 mm to 20 mm in the remaining section of the depth of the hole.

15. The method of claim 1, wherein the entire hole in the wooden item parallel with the fibre orientation is from 1200 mm to 2000 mm deep, the hole diameter is 38 mm in a first section closest to the top end face at a depth from 0 mm to 750 mm, and the hole diameter is 19 mm in the remaining section of the depth of the hole.

16. The method of claim 1, wherein a plurality of boles is provided parallel to the fibre orientation at the top end face of each wooden item.

17. The method of claim 1, wherein the wooden items are wooden poles.

18. The method of claim 17, wherein the wooden poles are bridge posts or mooring posts disposed in salty water.

19. The method of claim 1, wherein the step of forming the hole further includes forming the hole by drilling through the top end face of the wooden item parallel with the fibre orientation of the wood, and stopping drilling before reaching the bottom end of the wooden item, whereby the hole is formed with an open top end and a bottom closed end.

20. The method of claim 1, wherein the step of closing the open end of the hole includes disposing a removable plug within the hole open end.

* * * * *